United States Patent [19]

Gentili

[11] 4,150,523

[45] Apr. 24, 1979

[54] AUTOMATIC MACHINE FOR PACKING PRODUCTS OF PARALLELEPIPED SHAPE, PARTICULARLY REAMS OF PAPER

[75] Inventor: Vittorio Gentili, Bologna, Italy

[73] Assignee: Wrapmatic S.p.A., Bologna, Italy

[21] Appl. No.: 851,793

[22] Filed: Nov. 15, 1977

[30] Foreign Application Priority Data

Nov. 15, 1977 [IT] Italy ..... 41679 A/77

[51] Int. Cl.[2] ..... B65B 35/40; B65B 11/26

[52] U.S. Cl. ..... 53/535; 53/207; 53/287; 53/310; 53/574

[58] Field of Search ..... 53/535, 574, 578, 579, 53/207, 287, 312

[56] References Cited

U.S. PATENT DOCUMENTS

| | | | |
|---|---|---|---|
| 3,049,846 | 8/1962 | Jones | 53/579 X |
| 3,913,300 | 10/1975 | Benzing | 53/287 |

*Primary Examiner*—Travis S. McGehee

*Attorney, Agent, or Firm*—Browdy and Neimark

[57] ABSTRACT

An automatic machine for packing products of parallelepiped shape including a magazine for the boxes and a magazine for the lids. A line is provided for infeeding parallelepiped shaped products. A pusher is positioned to transfer the products from the infeed line exit to the central area of a box. A presser which acts on the product is arranged to push downwards the box and products a distance corresponding to the height of the products. Support locators which, with the step-by-step downward motion brought about by the presser, are fixed and cause the front and rear sections of the box to be folded upwards. A line is provided for moving forward the boxes, after their flaps are closed by the mounted fixed locators. A number of opposed rollers are arranged at the sides at the infeed line exit, for pressing the lateral sections against the flaps in order to permit them to be glued. A presser for pressing downwards the respective lids is provided with a plurality of downward curved rungs for causing the subsequent folding of sections and flaps of the lid after positioning over the products. Means are provided for distributing the glue over the flaps.

12 Claims, 4 Drawing Figures

D
C
A
B
I
24
27
19
18
20
22
25
26
16
28
23
21
14
9
15a
41
43
8
64
14
15a
34
7
4a
4b
3i
3f
3b
4e
3c
3h
3g
3e
31
33

AUTOMATIC MACHINE FOR PACKING PRODUCTS OF PARALLELEPIPED SHAPE, PARTICULARLY REAMS OF PAPER

This invention relates to an automatic machine for packing products of parallelepiped shape, particularly reams of paper. It has been found that for packing products of parallelepiped shape such as reams of paper, the cardboard boxes of the type customarily used have certain shortcomings related to the fact that the product support area is not perfectly flat due to the presence of cardboard overlap areas and that this results in damage being caused to the reams.

In order to overcome this problem it has been thought of effecting the packing using boxes and lids formed out of flattened material in which folding and cutting lines define a substantially rectangular central area which has along its sides sections that can be folded at a right angle thereto, the front and rear sections extending laterally with corresponding pairs of flaps that can be arranged at a right angle to the said sections and to the said central area and can go over and be glued to the lateral sections.

The automatic machines currently to be found on the market which produce a packing out of the aforementioned boxes and lids do not give satisfactory results both because of their somewhat slow running speed and because of the packing created not being perfect.

An object of the present invention is, therefore, to make available an automatic machine for packing products of parallelepiped shape, particularly reams of paper, which has an especially high output speed and is able to turn out packs that are practically perfect.

Another object of the present invention is to achieve the foregoing using a structure that is highly reliable, that operates efficiently and that can be easily suited to boxes, lids and products of various sizes.

These and other objects still which will emerge more clearly in due course have all been attained with the automatic machine according to the invention for packing products of parallelepiped shape, particularly reams of paper, essential features of which are that it comprises: a magazine for the boxes and a magazine for the lids in a flattened configuration; a line for infeeding the parallelepiped products; means for moving a box in its flattened configuration from the relevant magazine to a coplanar charging zone outside the said infeed line; pusher means from transferring the products from the infeed line exit to the central area of the box; a presser that acts vertically on the products arranged in the central area of the box to push downwards the box and products a distance corresponding to the height of the said products; fixed support locators which, with the step-by-step downward motion brought about by the presser, cause the front and rear sections of the box to be folded upwards; two spatulas rotatable round vertical shafts, operated subsequently to the lowering of the box, and able to fold forward the flaps of the said rear section; a line for moving forward the said boxes, on the sides of which are mounted fixed locators for causing, as the boxes advance, the folding back of the said flaps of the front section, and the folding upwards of the said lateral sections, means being provided for distributing the glue over the said lateral sections; a number of opposite rollers arranged at the sides at the infeed line exit, for pressing the said lateral sections against the said flaps in order to permit them to be reciprocally glued; means for moving a lid in its flattened configuration from the relevant magazine to an area overlying the exit from the said set of rollers; a pressure for pressing downwards the said lid, this being provided with a plurality of downward curved rungs for causing the subsequent folding of the sections and flaps of the lid after the central area of this has been located over the products, means being provided for distributing the glue over the said flaps.

Further characteristics and advantages will emerge more clearly from the following detailed description of a preferred but not the sole form of embodiment for a machine according to the invention, illustrated as an unlimited example on the accompanying drawings in which, in various scales:

Figures 1, 2:
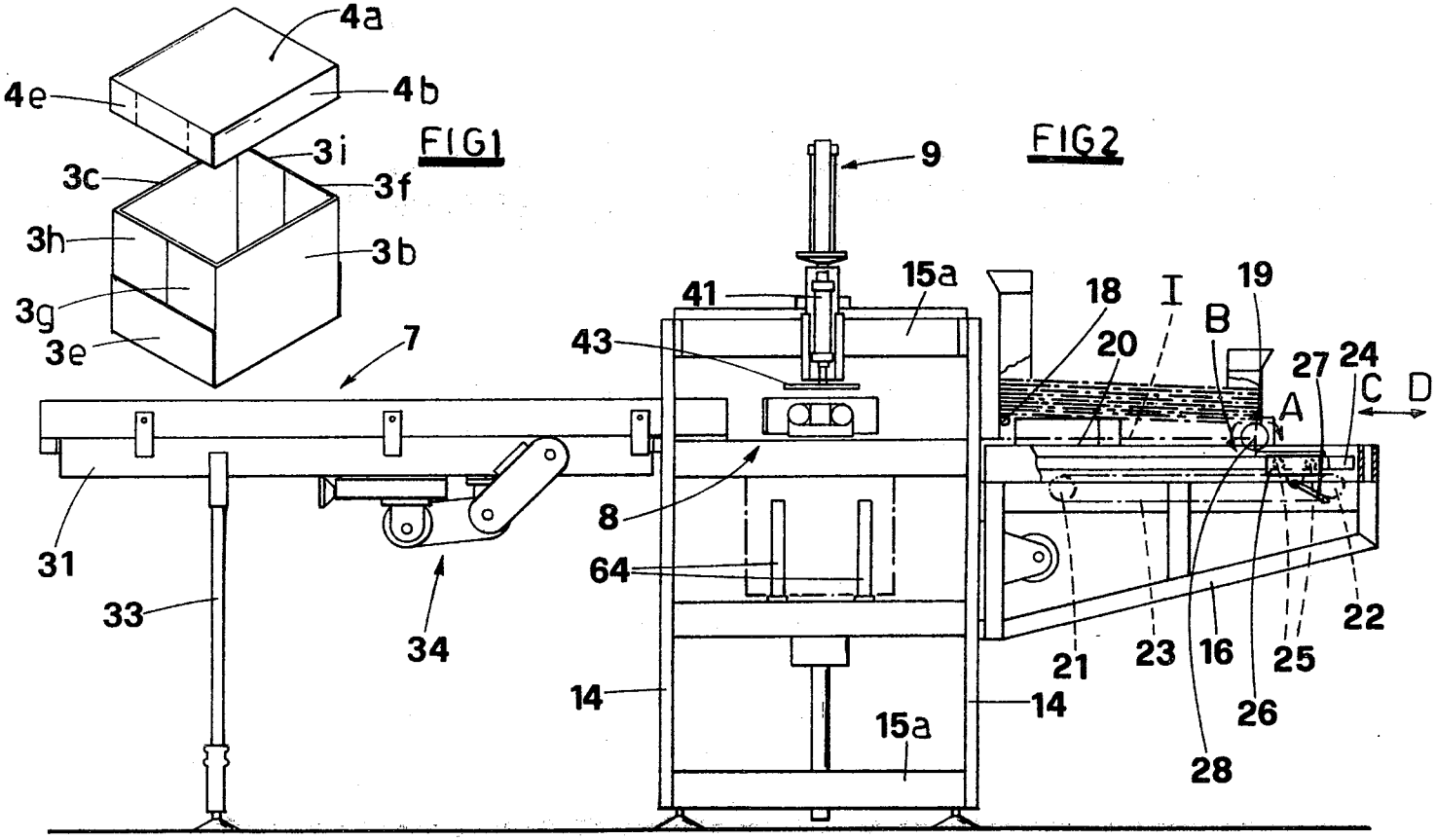
FIG. 1 shows in a perspective view one box and one lid.
FIG. 2 shows in front diagrammatic form, the machine according to the invention.

With particular reference to the figures listed above, at 1 there is the complete automatic machine forming the subject of the present invention, designed to pack the parallelepiped shape product 2 in boxes and lids fashioned out of flattened material 3-4. The said material 3-4 is customarily made of corrugated cardboard and is provided with cutting and folding lines which define the central areas **3*a*-4*a*, the front, rear and lateral sections, 3*b*-4*b*, 3*c*-4*c*, 3*d*-3*e* and 4*d*-4*e*, respectively, as well as the flaps 3*f*-3*g*, 3*h*-3*i*, 4*f*-4*g* and 4*h*-4*i***.

The machine 1 comprises the magazines 5 and 6 for the boxes and lids in flattened configuration, the line 7 for infeeding the products 2, the pusher 8, the pressers 9 and 10, the infeed line 11 and the set of rollers 12 carried by the frame 13 consisting of a structure of upright members 14, cross members **15*a* and longitudinal members 15*b***, welded one to the other.

The magazines 5 and 6 belonging to the boxes and the lids are carried, overhanging fashion, from the support frame 13 by the corresponding frames 16 and 17. Apart from their dimensions, the magazines and the means for moving the individual boxes and lids from the magazines to the utilization zones are virtually identical one with the other, and they are described and numbered cumulatively hereinafter.

The boxes 3 and the lids 4 are arranged one on the other and, on one side they rest on the rollers 18, and on the other, on the rollers 19, these being carried by the frames 16 and 17, respectively. The rollers 19 revolve first in the direction of the arrow A and then in that of the arrow B, the purpose of this being to first cause the extremities i-d-f of the cardboard material to be made by the roller 18 to drop on to a cardboard support platform 20 (line in dots and dashes marked I) and then to cause the extremities g-e-h to drop on to the same platform. Underneath the cardboard support platforms are arranged the pairs of gearwheels 21 and 22 around which are wound the chains 23. Between the platform and the upper part of the chain along the frames 16 and 17 are fixed the horizontal tracks 24 for guiding the rollers 25 of the carriages 26. To the carriages 26 are articulated the link rods 27 which, in turn, are articulated to the chains 23. As the latter are wound, the eyes of the link rods 27 are moved alternately along the upper and along the lower portions of the chains and this displaces the carriages 26 alternately in the direction of the arrows C and D. Fixed above the carriages 26 there are teeth 28 which pass through corresponding longitudinal flutes in the support platforms 20 and are designed to move the boxes and the lids deposited thereon in the direction of the arrow C and to arrange them in the areas of the machine marked II, with the boxes resting on the support brackets 29. The product infeed line 7 is of the type that consists of an endless conveyor belt 30 mounted over driven and idling rollers carried by the frame 31. The latter is provided with lateral guide walls 32 and is supported by an adjustable height leg 33. A drive group 34 of known type is positioned beneath the frame 31. At the exit from line 7 which infeeds the products 2 in the direction of the arrow E, a pneumatic jack 35 is secured to the frame 13 and this is parallel with the longitudinal axis (a) of the machine and has a horizontal piston carrying the pusher 36 which is guided along the two horizontal shanks 37. As the jack 35 operates in the direction of the arrow F, the said pusher contacts the products in order to carry them into the area 3a of the boxes arranged in position II. A locator 38 is fixed to the frame 13 to ensure the correct positioning of the products in the box. In the specific case illustrated in the drawing, it is envisaged that products arranged in superimposed pairs are to be arranged in the box and thus the width of the pusher 36 is slightly less than that of the two closely united products. At the exit from line 7, the frame 13 has fixed to it the longitudinal member 39 for locating and guiding the pairs of products coming from line 7 (position 21).

Above area **3*a* of the box in position II, the machine frame has fixed to it a cross member 40 which is integral with the vertical shaft mounted pneumatic jack 41 whose height, with respect to the cross member 40, is adjustable through a screw connected handwheel 42. Underneath the piston of the jack 41 is fixed the horizontal bracket 43 of the presser 9. The piston is operated alternately in the direction of the arrows G and H, its travel corresponding to the height of the products and its operation in direction G subsequently to the arrival of each pair of products in position 211 causes the products and the boxes to be lowered. Below the bracket 43 is the support bracket 44 which, guided along the vertical shanks 45 and actuated by the jack 46, lowers step-by-step with each operation of the bracket 43. On the sides of the frames are the pairs of members 47 which fold upwards the sections 3*b* and 3*c*** as the boxes are lowered.

Once a predetermined number of pairs of products have been arranged in the box, the boxes and products are in position III shown with dots and dashes in the drawing, with sections **3*b* and 3*c* of the box substantially at right angles to area 3*a*. Practically corresponding to the rear edges of the box, the machine frame has articulated to it pivotally the vertical spindles 48 and 49 with which the corresponding spatulas 50 are integral. With the rotation in the direction of the arrows I of the spatulas — the said rotation being achieved advantageously with means of the pneumatic jack type which are not shown on the drawings — the flaps 3*h* and 3*i* are folded forwards in such a way as to render them practically at right angles to areas 3*a* and 3*c*. Under the support platform 51 of the boxes in configuration III which extends up to the set of rollers 12, there is a longitudinal member 52 which is articulated to the upper extremities of the L shaped arms 53 and 54. These are centrally pivoted to the upright members 55 of the machine and their lower extremities are reciprocally fastened to the spindle 56 which together with the longitudinal member 52 and the arms 53 and 54 forms an articulated parallelogram. The lower extremity of the arm 54 is guided by the cam 57 which is so shaped that its rotation causes the raising and the lowering (arrows L) of the longitudinal member 52**.

Up above the latter is fixed the horizontal track 58 for guiding the carriage 59 which through the connecting rod 60 is linked to the endless chain 61 that turns around the gearwheels 62 and 63. As the chain unwinds, the rod 60, carried alternately along the upper and the lower portions thereof, causes the carriage 59 to undergo a to-and-fro motion (arrows M-N). The carriage 59 has articulated to it the front extremities of the L shaped arms 64 which carry the idle rollers 65 that rest on the longitudinal members 52. The gearwheel 63 and the cam 67 have one and the same drive and between one and the other the transmission ratio is such that when the carriage moves in the direction of the arrow M, the longitudinal member 58 is displaced upwards, whilst when the carriage moves in the direction of the arrow N, it is displaced downwards. In the latter configuration, along with the lowering of the longitudinal member 58, the roller 65 is also lowered and the arms 64 are carried into a configuration whereby their upper extremities remain below the platform 51.

During the movement in the direction of the arrow M, the arms 64 act on the box and its products and cause it to move from position III. On the sides of the frame are positioned converging curved locators 66 which determine the folding back of the flaps **3*f*-3*g* to carry them into a condition whereby they are at right angles with the area 3*a* and the section 3*b***.

Corresponding to where the locators 66 are to be found on the frame 13, glue distribution devices 67 are mounted and these are designed to spread predetermined quantities of glue on the sections **3*d*-3*e*. In order to achieve a faster glue open time, hot melt should ideally be used. Following on after the locators 66 there are tubular locators 68 which, commencing from the height of the platform 51, project upwards and converge towards the central area of the platform 51. As the boxes move forward, the locators 68 cause the folding upward of the sections 3*d*-3*e* until they are carried at right angles to the area 3*a* resting against the flaps 3*i*-3*f* and 3*h*-3*g***, respectively.

Downstream of the locators 68 there is the set of vertically mounted rollers 12 carried by the frames 69. The latter have integral with them pairs of transverse shanks 70 guided in the horizontal axis bushes **70*a* fixed to the frame 13, the distance the frames 69 are away from the axis (a) of the machine being adjustable through the handwheels 71** integral with corresponding adjusting screws.

Endless belts are mounted around the rollers 12, the latter being held pressing in the direction of the arrows (o) by elastic means of known type in such a way as to press the sections **3*d*-3*e* against the flaps 3*i*-3*f*-3*h*-3*g*** and to allow the glue to grip.

The drive group 73 is anchored to the frame 13 and through suitable reduction means, it actuates the gearwheel 63, the cam 57 and the rollers 12.

The boxes now formed around the products continue to move forward in the direction of the arrow M resting on a set of belts mounted around and supported by the transverse rollers 74 which are powered in a known fashion by the drive group **74*a* until they trip against the transverse stop 75. The latter is fixed to the piston of the pneumatic jack 75*a*, the operation of which is designed to move the stop 75** downwards underneath the plane on which the boxes travel along in order to allow the forward movement subsequent to the arrangement of the lid.

Each individual lid carrier into position II by the means described previously in respect of the boxes, is supported in that position by the lateral brackets 76 connected to the curved rungs 77 which point downwards and are fixed underneath the plate 78. The latter is fastened to the piston of the pneumatic jack 79 by the presser 10 and it carries integral with it the shanks 80 which are guided in corresponding vertical axis bushes fixed to the frame 13 of the machine.

Underneath the plate 78, the platform 81 is supported by means of the spindles 82 which pass through the plate 78 in sliding fashion, helical compression springs 83 being interposed between the plate and the platform.

With the lowering of the plate 78 in the direction of the arrow P brought about by the operation of the jack 79, the lid in a flattened configuration rests first of all on the box and on the products arranged in configuration IV. Subsequently the platform 81 pushes the area 4*a* of the lid on to the products. With the further lowering of the plate and whilst the platform 81 is stopped by the products, the said rungs 77 determine first of all the downward folding of the sections 4*b*-4*c*, then the rungs 77*a* fold the flaps 4*i*-4*h*-4*f*-4*g* forwards and backwards and finally the rungs 77*b* fold the sections 4*d*-4*e* downwards. This folding succession is achieved thanks to the vertical parts of the curved rungs 77-77*a*-77*b* being of different lengths.

It should be noted that the exit from the magazine 6 glue distribution devices 84 are positioned and that these deposit glue on to the upper surface of the flaps 4*i*-4*h*-4*f*-4*g* in such a way that when the sections 4*d*-4*e* are folded and pressed on to the aforementioned flaps 4*i*-4*h*-4*f*-4*g*, they remain glued thereto.

Underneath the said glue distribution devices 84, spaced away therefrom a distance equal to the thickness of the lid, further glue distribution devices (not visible on the drawings since they are covered by the distributors 84) are positioned and these attend to spreading the glue on the lower surface of the flaps 4*i*-4*h*-4*f*-4*g* and the sections 4*b*-4*c* to enable the lid to be secured to the box.

The succession of operational sequences is achieved through the use of electronic detection and control groups.

Figure 4:
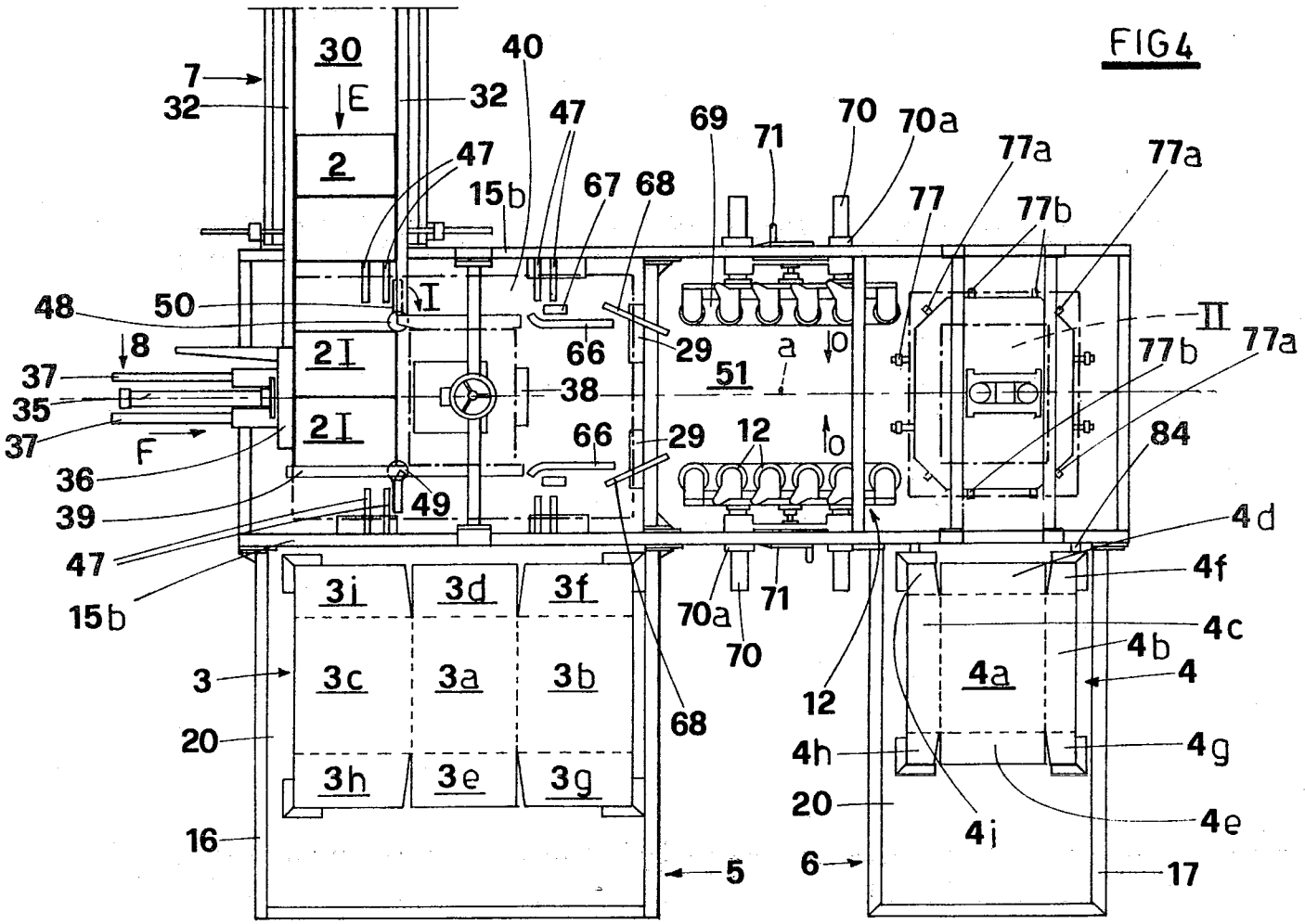
FIG. 4 shows a plan view of the machine.

In operation, the machine packs reams of paper placed two by two, one upon the other; a pair of such reams are shown coming from the feeding line 7, these reams move against the longitudinal member 39 which predisposes the pair of reams in position 2I for the subsequent action of the pusher 36 (FIG. 4).

The pusher 36, with horizontal reciprocating motion, carries the pairs of reams from the predisposition configuration 2I to the positioning configuration 2II (FIG. 3), in which the same pair is supported upon the area 3*a* corresponding to the bottom of the box 3. It is evident that, during this phase, the support bracket 44 is in its highest position supporting the area 3*a* of the box 3 on the side opposite to the one presenting the pair of reams.

Subsequently the pair of reams in position 2II is lowered of a step (regulable) corresponding to the height of the same ream for a contemporaneous action of the bracket 43 of the presser 9 and of the support bracket 44. This contemporaneous lowering of the bracket 43 and of the support bracket 44, obtained by means of a contemporaneous pneumatic or hydraulic action respectively of the jacks 41 and 46, causes the releasing of the box 3 (still in flattened configuration) from the support brackets 29. The function of presser 9 (which after the working stroke according to the arrow G returns in rest position) is to secure the exact lowering of the pair of reams of a step corresponding to the height of the same reams, in order to allow the advance of the following pair above the preceding, being certain to have no stumbling during this phase.

Figure 3:
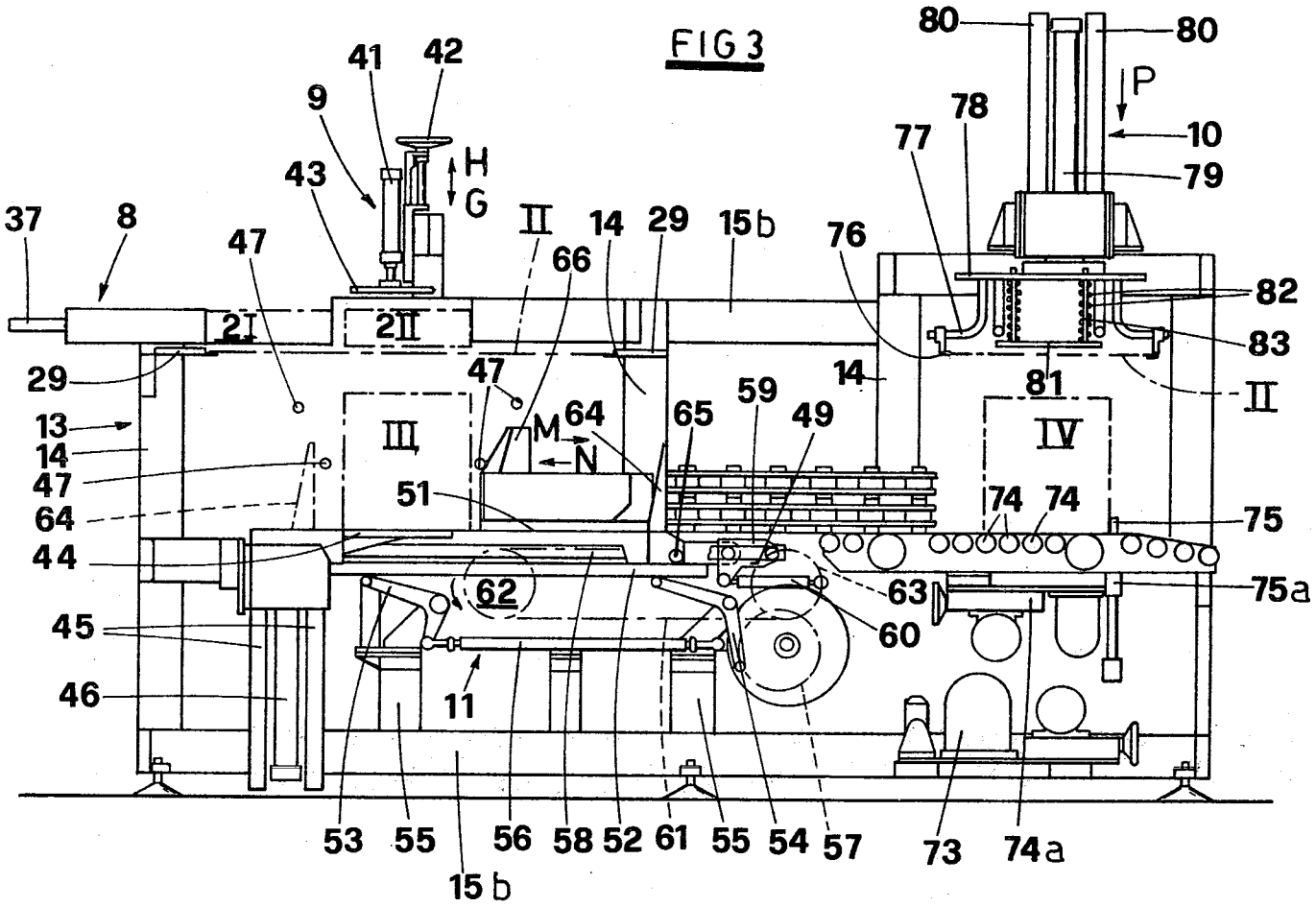
FIG. 3 shows a lateral view of the said machine.

Proceeding on with the piling of the reams, the support bracket 44 lowers step-by-step till when the flaps 3*f*, 3*g* and 3*h*, 3*i* at first hit against the higher members 47, beginning to fold together with the flaps 3*c*, 3*b* upwards, and subsequently, the flaps 3*f*, 3*g* and 3*h*, 3*i* hit against the lower members 47, determining in such a way the complete vertical folding of the same flaps 3*c*, 3*b*, while the flaps 3*h*, 3*i* and 3*g*, 3*f* remain in the same plane with the flaps 3*c*, 3*b* (configuration III of FIG. 3).

The presser 9 operates in such a way according to the number of pairs of reams to be piled; that is to say, a contemporaneous lower step-by-step both of the bracket 43 and of the support bracket 44 is effected till when a suitable meter, associated with the presser 9, counts the predetermined number of strokes (lowerings). The meter, upon reaching this number, effects operation of the presser 9 and the continuous lowering of the support bracket 44 (FIG. 3).

The invention as designed fulfils the proposed objects and, in particular, makes is possible to rapidly pack products of parallelepiped shape in a way that is practically perfect.

Without in any way deviating from the framework of the invention it is liable to undergo numerous modifications and variants.

Furthermore, all parts may be substituted with others of equal technical merit.

In actual practice the materials used, as well as their shapes and dimensions can vary to suit the requirements without any loss of the protection afforded to the following claims.

I claim:

1. Automatic machine for packing products of parallelepiped shape, particularly reams of paper, essential features of which are that it comprises: a magazine for the boxes (5) and a magazine for the lids (6) in a flattened configuration; a line (7) for infeeding the parallelepiped products; means for moving a bbox in its flattened configuration from the relevant magazine to an almost coplanar charging zone outside the said infeed line; pusher means (8) for transferring the products from the infeed line exit to the central area of the box; a presser (9) that acts vertically on the products arranged in the central area of the box to push downwards the box and products a distance corresponding to the height of the said products; fixed lateral locators (47) which, with the step by step downward motion brought about the presser, cause the front (3*b*) and the rear (3*c*) sections of the box to be folded upwards; two spatulas (50) rotatable around vertical shafts, operated subsequently to the lowering of the box, and able to fold downwards the flaps (3*h*) and (3*i*) of the said rear section with respect to the advancement direction; a line for moving forward the said boxes, on the sides of which are positioned fixed locators (66) and (68) for causing, as the boxes advance in the direction shown as (F), the folding back of the said flaps (3*f*) and (3*g*) of the front section (3*b*), and the folding upwards of the said lateral sections (3*c*) and (3*d*), means being provided for distributing the glue (67) over the said lateral sections; a number of opposite rollers (12) arranged at the sides at the infeed line exit, for pressing the said lateral sections against the said flaps in order to permit them to be reciprocally glued; means for moving a lid in its flattened configuration from the relevant magazine to an area overlying the exit from the said set of rollers; a presser (10) for pressing downwards the said lid, this being provided with a plurality of rungs (77), curved downwards and various heights, for causing the subsequent folding of the sections and flaps of the lid after the central area of this has been located over the products, means (84) being provided for distributing the glue over the said flaps.

2. Machine according to claim 1, wherein the said means for moving the boxes and lids comprise two rollers (18) and (19), respectively, for supporting the lateral extremities of the boxes or lids, one of which driven alternately in one direction or the other, in order to cause each individual box or lid to drop subsequently on to the support platform (20).

3. Machine according to claim 2, wherein below the said support platform (20) there is a carriage (26) guided to slide to-and-fro, on the upper part of which is carried a tooth (28) able to protrude above the said platform and to press the edge of the box or lid, in order to bring it into its usage configuration.

4. Machine according to claim 1, wherein the said box infeed line is constituted by at least one L shaped arm (64) which, during infeed, projects above a box support platform (51), and stays below the said platform when non-operative.

5. Machine according to claim 4, wherein the said L shaped arm has its horizontal part connected to a carriage (59) guided along a longitudinal track (58), the said arm resting on a longitudinal member (52) at a point corresponding to the union vertex thereof.

6. Machine according to claim 5), wherein the said longitudinal member (52) is connected in the form of an articulated parallelogram, through the arms (54) and (53), to the frame of the machine and is made to be raised or lowered by a cam (57), with the lowering of the longitudinal member the upper extremities of the vertical parts of the L shaped arms are positioned beneath the platform (51) on which the boxes slide.

7. Machine according to claim 5, wherein the said carriage (59) is connected by means of a link rod (60) to an endless chain (61) whose upper and lower portions are substantially parallel with the longitudinal axis of the machine.

8. Machine according to claim 1 wherein endless belts encompass the said set of rollers (12), the said rollers being pressed by corresponding elastic means towards the central longitudinal axis of the machine.

9. Machine according to claim 1, wherein the said lid presser carries slidable at its lower part, through interposed elastic means (83), a platform (81) for pressing the central area of the lids on to the products at the time the said curved rungs are being lowered.

10. Machine according to claim 1, wherein the said fixed locators of the infeed line comprise two converging curved locators (66) for folding back the front section flaps, and two sloping tubular locators (68) which rise from the box support platform and converge towards the longitudinal axis of the machine for the folding upwards of the lateral sections.

11. Machine according to claim 1, wherein below the product presser there is a support bracket (44), lowerable step by step, the said bracket being guided vertically and operated by a vertical shaft jack (46).

12. Machine according to claim 1, wherein the said means for distributing the glue (84) on the lid are placed at the exit from the said magazine for the lids and comprise two upper distributors, for gluing the flaps in order to form the lids, and two lower distributors for gluing under the flaps and front and rear sections so as to secure the lids to the boxes.

* * * * *